United States Patent [19]

Zukowski

[11] Patent Number: 4,532,395

[45] Date of Patent: Jul. 30, 1985

[54] ELECTROLUMINESCENT FLEXIBLE TOUCH SWITCH PANEL

[75] Inventor: Raymond W. Zukowski, Harwinton, Conn.

[73] Assignee: Timex Corporation, Waterbury, Conn.

[21] Appl. No.: 534,007

[22] Filed: Sep. 20, 1983

[51] Int. Cl.[3] ..... H01H 9/16

[52] U.S. Cl. ..... 200/314; 200/317

[58] Field of Search ..... 200/5 A, 310, 313, 314, 200/317

[56] References Cited

U.S. PATENT DOCUMENTS

| | | | |
|---|---|---|---|
| 2,928,974 | 3/1960 | Mash | 313/108 |
| 2,988,661 | 6/1961 | Goodman | 313/108 |
| 4,060,703 | 11/1977 | Everett | 200/317 |
| 4,414,452 | 11/1983 | Denley | 200/317 |
| 4,496,812 | 1/1985 | Carley et al. | 200/314 |

OTHER PUBLICATIONS

IBM Technical Disclosure Bulletin, vol. 13, No. 3, Aug. 1970, p. 742, "Luminescing Flexible Switch", W. W. Ellington.

*Primary Examiner*—John W. Shepperd

*Attorney, Agent, or Firm*—William C. Crutcher

[57] ABSTRACT

A flexible touch switch panel of a known type with a deformable membrane carrying a switch closure member is provided with an overlying flexible electroluminescent laminated member providing lighting of the entire switch panel or selected areas thereof, including lighting of keytop indicia on the flexible touch switches.

3 Claims, 3 Drawing Figures

ELECTROLUMINESCENT FLEXIBLE TOUCH SWITCH PANEL

BACKGROUND OF THE INVENTION

Briefly stated, this invention relates to illuminated flexible touch switches, and more particularly to flexible touch switches having electroluminescent lighting of the switch panel or selected portions thereof, including keytop indicia.

Flexible touch switches have been proposed with electroluminescent panels disposed behind the switches. For example, U.S. Pat. No. 4,318,839—Schwerdt discloses an electroluminescent panel behind a flexible touch switch with the illumination passing through a hole in an opaque top condutive member on a deformable membrane forming part of the touch switch.

U.S. Pat. No. 4,060,703 discloses a sandwich type computer keyboard with a flexible electroluminescent panel forming part of a laminated structure to provide backlighting of a translucent sheet of bubbles labeled with alphanumeric legends forming the keytops.

U.S. Pat. No. 4,320,268—Brown discloses a flexible membrane keyboard disposed below an electroluminescent panel with holes in the panel to allow push button actuators to pass through the electroluminescent panel and to close the underlying switches when pushed from above. The push buttons are transparent and illuminated from beneath by the electroluminescent panel. The foregoing patents are exemplary of the prior art, in which the electroluminescent member is disposed beneath the pushbutton and simply illuminates it by providing backlighting.

It would be desirable to provide a simple illuminated flexible touch switch, which is provided in simple laminated constructions and adaptable to large panels of flexible touch switches. It would also be desirable to provide an illuminated touch switch in which the EL panel itself is flexible and incorporates the indicia on the key as part of the EL panel.

Accordingly, one object of the invention is to provide an illuminated flexible touch switch panel of simple laminated construction.

Another object of the invention is to provide an electroluminescent panel which incorporates the keytop indicia and forms an integral part of a flexible touch switch panel.

These and other objects of the invention will become apparent by reference to the following description, taken together with the accompanying drawings, in which.

SUMMARY OF THE INVENTION

Briefly stated, the invention is practiced by providing a first flexible touch switch laminated portion including a first deformable insulated membrane having a switch closure member thereon adapted to cooperate with a second underlying member having a plurality of switch terminal members thereon; and a second laminated electroluminescent portion, comprising a back conductive layer disposed adjacent to said deformable membrane, a dielectric matrix or phosphor in a resin binder, a second transparent conductive layer, and a transparent flexible outer keytop member. The keytop may have an indicia formed thereon and is aligned with said switch closure member, whereby said keytop (and indicia) is illuminated by the electroluminescent phosphor. Pressing the illuminated keytop deforms said flexible membrane to close the switch.

DESCRIPTION OF THE PREFERRED EMBODIMENT

Figure 1:
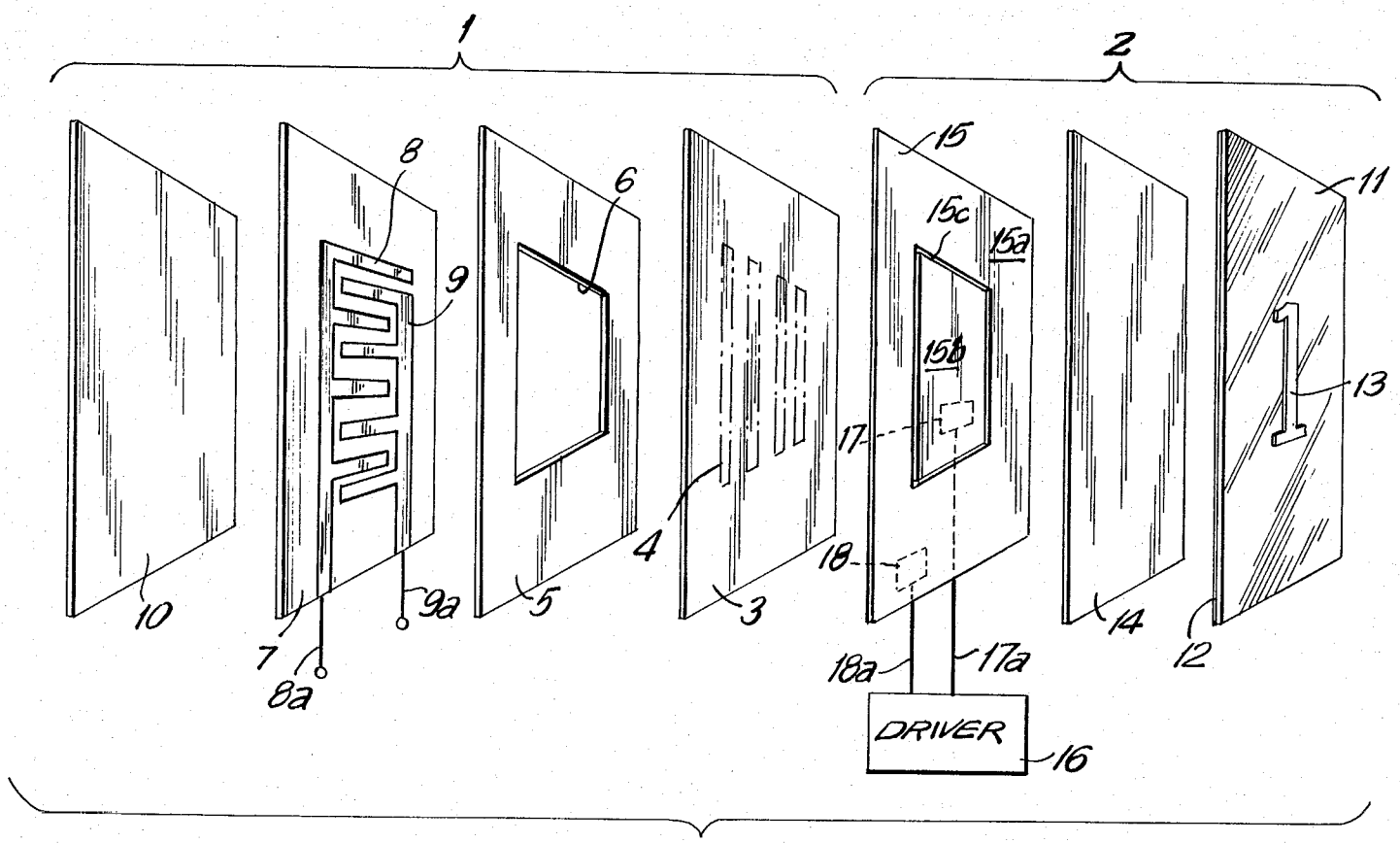
FIG. 1 is an exploded view of an illuminated flexible touch switch.

Referring now to FIG. 1 of the drawing, the illuminated touch switch comprises a first laminated switch portion 1, and a second laminated electroluminescent portion 2. The switch portion 1 includes a deformable membrane 3 of insulating material with conductive switch closure members 4 thereon on the side away from the viewer, as indicated by phanton lines. A spacer member 5 of insulating material has a cut-out opening 6. A second sheet of insulating material 7 with spaced electrically conductive areas imprinted thereon. Conveniently these may be a first conductive terminal area 8 interleaved with a second conductive terminal area 9 and connected to external switch terminals via leads 8*a* and 9*a*. Lastly, a relatively rigid backing member 10 provides sufficient rigidity to support conductive areas 8, 9, when the flexible membrane with switch closure members 4 is pressed against it. The rigid sheet 10 is optional, since the insulating sheet 7 may be made of rigid insulating material and serve this purpose.

The other laminated portion 2 comprising the flexible electroluminescent panel comprises a transparent flexible insulating sheet 11, preferably of Mylar (registered trademark of E. I. duPont de Nemours and Co.). On the underside of flexible sheet 11 (away from the viewer) is a thin layer 12 of conductive material, such as indium oxide. There may be imprinted on either side of the Mylar sheet, if desired, an indicia, such as an alphanumeric character. A thin coating of translucent paint may be sprayed on the Mylar to provide a better surface for printing the indicia.

Adhered to the conductive coating 12 is a coating of a dielectric matrix of electroluminescent phosphor encapsulated in an epoxy resin, such as Loctite 75 manufactured by Loctite Corporation. Matrix 14 may be on the order of 1–5 mils thick. Lastly, conductive layer 15, of particulate material, which may be a commercially available nickel-containing material called Emilux manufactured by General Electric Company is deposited. The conductive layer 15 is preferably subdivided into two electrodes 15*a*, 15*b*, in a manner described in copending application Ser. No. 423,772 filed Sept. 27, 1982 in the name of A. D'Onofrio, and its continuation-in-part application Ser. No. 514,078 filed July 15, 1983. The foregoing applications, which are assigned to the present assignee, disclose a "split electrode" arrangement, wherein one conductive coating is split into two or more electrodes. An electroluminescent driving circuit 16 is connected to supply a source of driving potential for the electroluminescent panel to terminals 17, 18 via leads 17*a*, 18*a*. Contact terminals 17, 18 are arranged to be in electrical contact with the conductive areas 15*a*, 15*b* respectively. Conveniently, in implementing the present invention, the terminals 17, 18 may be imprinted upon the front side of the flexible membrane 3, so that when laminated portion 2 is laid upon laminated portion 1, the drive circuit 16 will be pressed against and effectively connected to the conductive areas 15*a*, 15*b* to activate the electroluminescent panel. By appropriately preselecting the surface area of electrode 15*b* with respect to that of electrode 15*a*, the size and brightness of area 15*b* can be controlled. The electroluminescent driver 16 may vary from a simple AC source, to a source of high voltage, high frequency pulsed output as more particularly described in copending application Ser. No. 362,708 filed Mar. 29, 1982.

Figure 2:
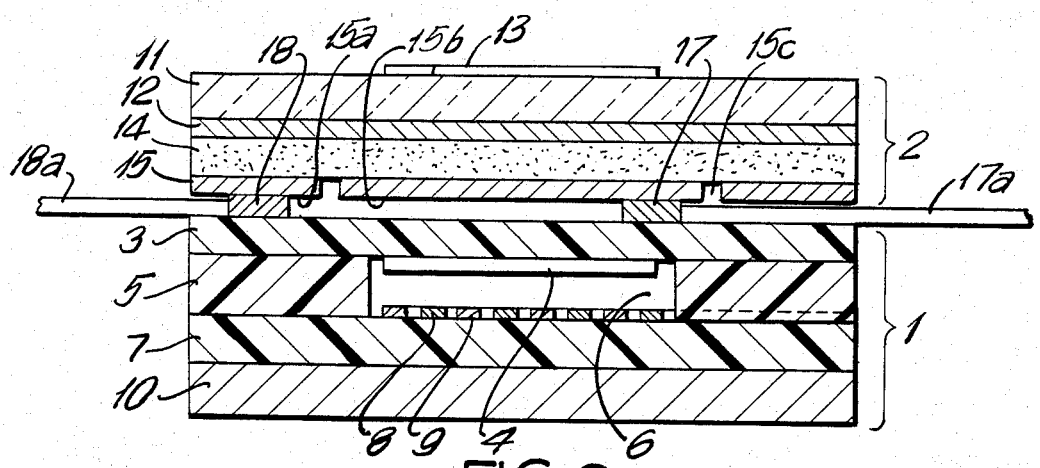
FIG. 2 is a cross-section of a illuminated switch according to the present invention.

Referring to FIG. 2 of the drawing shown in cross section with the layers greatly exaggerated in size and not drawn to scale, it is seen that the first laminated portion 1 preferably has the electroluminescent drive contact terminal 17, 18 placed such that when the second laminated portion 2 is placed thereon, the terminals contact the electrode area 15*a*, 15*b*. An insulating groove 15*c* separates the two electrode areas. At the same time, the indicia 13 is aligned to be disposed above the switch closure contact area 4 on the flexible membrane 3. The driver circuit 16 is connected to leads 17*a*, 18*a* causes the electroluminescent matrix 14 to glow or luminesce, providing high visibility for the indicia 13. When the indicia is pressed, since both the electroluminescent laminated portion 2 and flexible membrane 3 are relatively thin and flexible, the closure member 4 will close the switch contact areas 8, 9. Conductive area 15*b* may be selectively actuated to light only the desired indicia, in a manner described in applicant's copending C-I-P application Ser. No. 514,078, or alternatively, the conductive area 15*b* may be made smaller and thus glow more brightly than the background area, thereby highlighting the location of indicia 13 against the background.

Although the construction shown in FIGS. 1 and 2 describes only a single switch, it is contemplated by the present invention that a panel or plurality of illuminated touch switches are provided in the same manner by simply providing more conductive areas and imprinted indicia in the same manner as described above.

Figure 3:
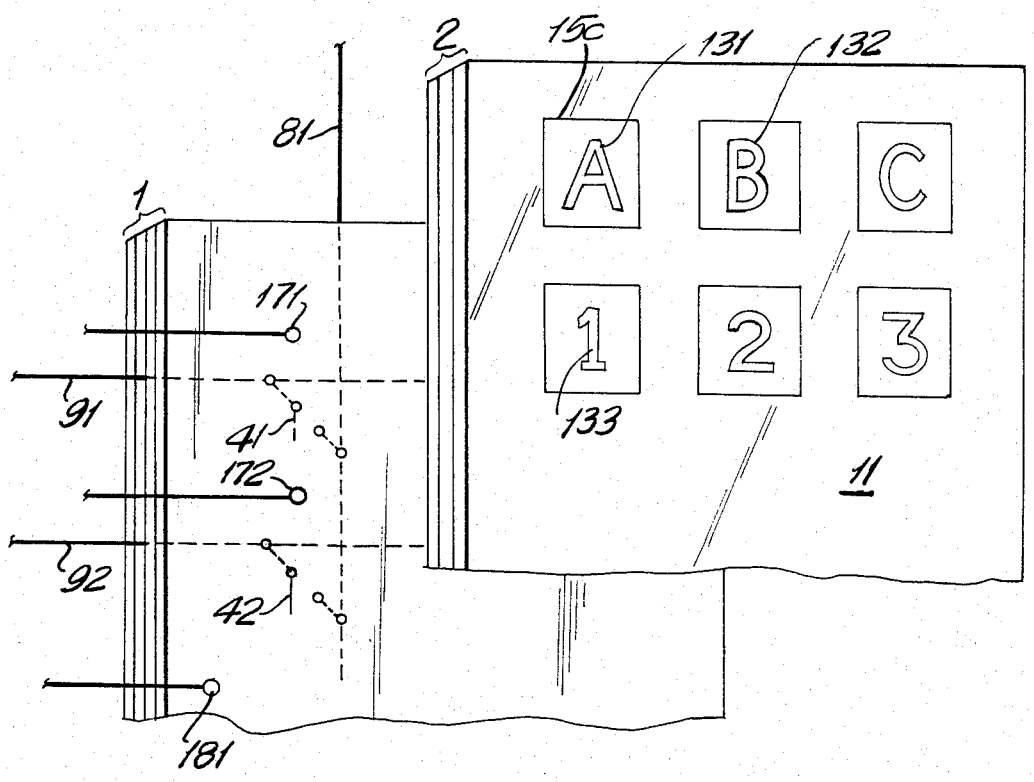
FIG. 3 is an exploded perspective view of a portion of a panel using a number of the switches according to the invention.

FIG. 3 of the drawing illustrates the touch switch being extended to a complete panel of switches by simple extension of the ideas illustrated in FIGS. 1 and 2. The laminated electroluminescent portion 2 includes the laminated members mentioned previously, except that there are a plurality of indicia such as alphanumeric characters 131, 132, 133, etc. imprinted on the upper flexible insulated sheet 11 of the electroluminescent laminated portion 2. The laminated portion 1 comprising the flexible switch matrix includes a plurality of switch closure members depicted symbolically as 41, 42, which are aligned with indicia 131, 133. The interleaved switch terminal members are arranged in matrix fashion as depicted by conductor leads 81, 91, 92. The upper surface of the laminated portion 1 has electroluminescent drive contact terminals 171, 172 for illuminating the respective indicia 131, 133, and a "common" contact terminal 181 for the electrode area surrounding the indicia. The groove spacing each electrode area from the common area is indicated at 15*c*.

While there has been described what is considered to be the preferred embodiment of the invention, other modifications will occur to those skilled in the art, and it is desired to secure in the appended claims all such modifications as fall within the true spirit and scope of the invention.

I claim:

1. An illuminated flexible touch switch comprising a first laminated switch portion and a second flexible laminated electroluminescent portion, said first laminated switch portion including a flexible insulated membrane having a conductive switch closure member thereon, a spacer member having an opening aligned with the switch closure member, and an insulated backing member having a plurality of switch contact terminals areas thereon arranged to be connected by said switch closure member upon deformation of the flexible membrane, said second flexible laminated electroluminescent portion including a first conductive layer, a dielectric matrix comprising a layer of electroluminescent phosphor and epoxy resin, a second transparent conductive layer, and a transparent insulating layer providing a keytop area thereon, wherein said first conductive layer is subdivided into at least two electrodes, and wherein at least two associated contact terminals are disposed on said flexible membrane, said contact terminals being in contact with said respective electrodes, said keytop area being aligned with said switch closure member, whereby pressing the keytop area actuates the switch, and wherein one of said electrodes is aligned with said keytop area and smaller than the other electrode, whereby the keytop area is brighter than the background area.

2. The combination according to claim 1, wherein said keytop area has an indicia imprinted thereon adapted to be illuminated by said phosphor.

3. A switch panel comprised of illuminated flexible touch switches according to claim 1, wherein there are a plurality of spaced keytop areas and a plurality of switch closure members aligned respectively with one another to provide an illuminated switch panel.

* * * * *